US006017858A

United States Patent [19]

Karol et al.

[11] Patent Number: 6,017,858

[45] Date of Patent: Jan. 25, 2000

[54] SYNERGISTIC ORGANOMOLYBDENUM COMPOSITIONS AND LUBRICATING COMPOSITIONS CONTAINING SAME

[75] Inventors: Thomas J. Karol, Norwalk; Steven G. Donnelly, New Fairfield, both of Conn.

[73] Assignee: R.T. Vanderbilt Co., Inc., Norwalk, Conn.

[21] Appl. No.: 09/046,954

[22] Filed: Mar. 24, 1998

Related U.S. Application Data

[63] Continuation-in-part of application No. 08/005,962, Jan. 19, 1993, abandoned.

[51] Int. Cl.[7] ..... C10M 141/06; C10M 141/08; C10M 141/10; C10M 141/12

[52] U.S. Cl. ..... 508/303; 508/364; 508/365; 508/431

[58] Field of Search ..... 508/274, 303, 508/362, 363, 378, 364, 365, 431

[56] References Cited

U.S. PATENT DOCUMENTS

| | | |
|---|---|---|
| 2,492,314 | 12/1949 | Olin et al. . |
| 3,567,638 | 3/1971 | Braid . |
| 4,164,473 | 8/1979 | Coupland et al. . |
| 4,215,067 | 7/1980 | Brannen et al. . |
| 4,648,985 | 3/1987 | Thorsell et al. . |
| 4,761,482 | 8/1988 | Karol . |
| 4,889,647 | 12/1989 | Rowan et al. . |
| 4,925,596 | 5/1990 | Maeda et al. . |

*Primary Examiner*—Margaret Medley
*Attorney, Agent, or Firm*—Baker & Botts, L.L.P.

[57] ABSTRACT

This invention relates to synergistic antiwear compositions comprising an organomolybdenum complex and an organic sulfuir compound selected from 2,5-dimercapto-1, 3,4-thiadiazole derivatives, bisdithiocarbamate esters, metal dithiocarbamates, metal phosphorodithioates and phosphorodithioate esters. The organomolybdenum complex is a reaction product prepared by reacting 1 mole fatty oil, 1.0 to 2.5 moles diethanolamine and a molybdenum source.

Lubricating compositions containing the synergistic compositions possess good antiwear properties and improved oxidation stability.

8 Claims, No Drawings

SYNERGISTIC ORGANOMOLYBDENUM COMPOSITIONS AND LUBRICATING COMPOSITIONS CONTAINING SAME

This application is a continuation-in-part application of application Ser. No. 08/005962 filed Jan. 19, 1993 now abandoned.

BACKGROUND OF THE INVENTION

The invention concerns lubricating compositions having improved properties. Another aspect of the invention relates to additive compositions which impart antiwear and antiscuffing properties to lubricating compositions used for internal combustion engines such as gasoline engine and diesel engine.

Additives known as antiwear agents are employed to increase the load carrying capacity of lubricants. The antiwear agents promote the formation of a surface film and thereby prevent wear of the contacting surfaces. The mechanical efficiency enhanced by decreased friction loss further results in decreased fuel consumption and energy savings.

It is known that certain organic molybdenum complexes possess antiwear properties as well as other desirable lubricating characteristics as disclosed in U.S. Pat. No. 4,889,647. Organic molybdenum complexes can be combined with sulfur donors as described in U.S. Pat. No. 4,164,473. Surprisingly, it has been now discovered that the molybdenum complexes described therein produce a synergistic antiwear effect in combination with certain organic sulfur compounds. Unexpectedly, the synergistic composition lowers the friction characteristics of the protected surface by effecting changes in its metallurgy.

SUMMARY OF THE INVENTION

According to the invention, there are provided synergistic antiwear compositions comprising:

(1) an organomolybdenum complex prepared by reacting about 1 mole fatty oil, about 1.0 to 2.5 moles diethanolamine and a molybdenum source sufficient to yield about 0.1 to 12.0 percent of molybdenum based on the weight of the complex, and (2) an organic sulfur compound selected from the group consisting of (i) 1,3,4-thiadiazole compounds of the formula:

(I)

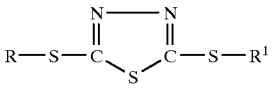

wherein R and R' are independently selected from $C_{1-22}$-alkyl groups, terpene residue and maleic acid residue of the formula

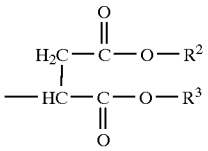

and $R^2$ and $R^3$ represent $C_{1-22}$-alkyl and $C_{5-7}$-cycloalkyl groups, R or $R^1$ and either $R^2$ or $R^3$ may be hydrogen;

(ii) bisdithiocarbamate compounds of the formula (II)

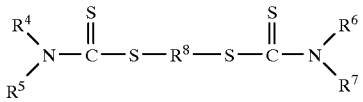

wherein $R^4$, $R^5$, $R^6$, and $R^7$ are aliphatic hydrocarbyl groups having 1 to 13 carbon atoms and $R^8$ is an alkylene group having 1 to 8 carbon atoms;

(iii) dithiocarbamates of the formula (III)

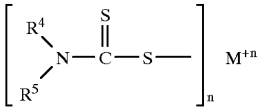

wherein $R^4$ and $R^5$ represent alkyl groups having 1 to 8 carbon atoms, M represents metals of the periodic groups IIA, IIIA, VA, VIA, IB, IIB, VIB, VIII and a salt moiety formed from an amine of the formula

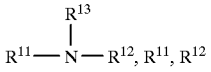

and $R^{13}$ being independently selected from hydrogen and aliphatic groups having 1 to 18 carbon atoms and n is the valence of M;

(iv) phosphorodithioates of the formula (IV)

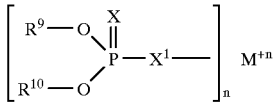

wherein X and X' are independently selected from S and O, $R^9$ and $R^{10}$ represent hydrogen and alkyl groups having 1 to 22 carbon atoms, M represents metals of the periodic groups IIA, IIIA, VA, VIA, IB, IIB, VIB, VIII and a salt moiety formed from an amine of the formula

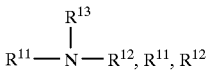

and $R^{13}$ being independently selected from hydrogen and aliphatic groups having 1 to 18 carbon atoms and n is the valence of M; and (v) phosphorodithioate esters of the formula

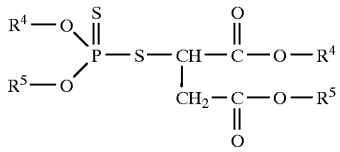

(V)

wherein $R^4$ and $R^5$ may be the same or different and are selected from alkyl groups having 1 to 8 carbon atoms; and the ratio of the molybdenum complex to the sulfur compound is about 1:5 to about 5:1.

Another aspect of the invention concerns lubricating compositions having improved lubricating properties and comprising a major portion of an oil of lubricating viscosity and about 0.1 to 10.0 percent by weight of a composition comprising (1) an organomolybdenum complex prepared by reacting about 1 mole fatty oil, about 1.0 to 2.5 moles diethanolamine and a molybdenum source sufficient to yield about 0.1 to 12.0 percent of molybdenum based on the weight of the complex and (2) a sulfur compound of the formula I, II, III, IV or V.

DETAILED DESCRIPTION OF THE INVENTION

The organomolybdenum component of the invention is prepared by sequentially reacting fatty oil, diethanolamine and a molybdenum source by the condensation method described in U.S. Pat. No. 4,889,647, incorporated herein by reference. The reaction yields a reaction product mixture. The major components are believed to have the structural formulae

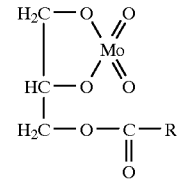

and

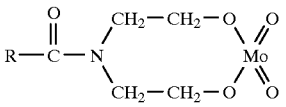

wherein R represents a fatty oil residue. The preferred fatty oils are glyceryl esters of higher fatty acids containing at least 12 carbon atoms and may contain 22 carbon atoms and higher. Such esters are commonly known as vegetable and animal oils. Vegetable oils particularly useful are oils derived from coconut, corn, cottonseed, linseed, peanut, soybean and sunflower seed. Similarly, animal fatty oils such as tallow may be used.

The source of molybdenum is an oxygen-containing molybdenum compound capable of reacting with the intermediate reaction product of fatty oil and diethanolamine to form an ester-type molybdenum complex. The source of molybdenum includes, among others, ammonium molybdates, molybdenum oxides and mixtures thereof.

The 1,3,4-thiadiazoles of formula I may be prepared by the method disclosed in U.S. Pat. No. 4,761,842 and U.S. Pat. No. 4,880,437 incorporated herein by reference. Terpene residues are preferably derived from pinene and limonene having the structural formulae given hereinbelow.

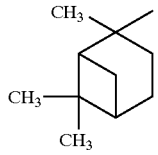

and

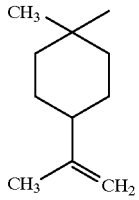

The alkyl groups represented by R and R' contain preferably 1 to 22 carbon atoms and may be branched or straight chain. Particularly preferred are compounds wherein both alkyl groups together contain a total of at least 22 carbon atoms. Groups $R^2$ and $R^3$ in the formula I represent branched or straight chain alkyl groups containing 1 to 22 carbon atoms and cyclic aliphatic groups such as cyclohexyl, cyclopentyl and cycloheptyl.

The bisdithiocarbamates of formula II are known compounds described in U.S. Pat. No. 4,648,985, incorporated herein by reference. The compounds are characterized by groups $R^4$ to $R^7$ which are the same or different and are hydrocarbyl groups having 1 to 13 carbon atoms. Preferred are branched or straight chain alkyl groups having 1 to 8 carbon atoms. The group $R^8$ is an aliphatic group such as straight and branched alkylene groups containing 1 to 8 carbons. Particularly preferred is methylenebis (dibutyldithiocarbamate) available commercially under the tradename VANLUBE® 7723 from R.T. Vanderbilt Company, Inc.

The dithiocarbamates of the formula III are known compounds. One of the processes of preparation is disclosed in U.S. Pat. No. 2,492,314. Groups $R^4$ and $R^5$ in the formula III represent branched and straight chain alkyl groups having 1 to 8 carbon atoms. Particularly preferred are antimony and zinc dithiocarbamates.

The phosphorodithioates of the formula IV are known, commercially available materials. One of the processes of preparation is taught by U.S. Pat. No. 4,215,067. Groups $R^9$ and $R^{10}$ represent branched and straight chain alkyl groups having 1-22 groups and may be derived from fatty acids. Particularly preferred are zinc phosphorodithioates. The metal ion in formula III and IV may be selected from the following groups of the Periodic Table: IIA, IIIA, VA, VIA, IB, IIB, VIB and VIII. Amine salts of the compounds are also useful synergists of the invention. Exemplary, salts include, among others, those prepared from alkyl amines and mixed alkyl amines. Particularly useful are fatty acid amines.

The phosphorodithioate esters of the formula V are known compounds. One of the processes of manufacture is disclosed in U.S. Pat. No. 3,567,638. Groups $R^4$ and $R^5$ in the formula V may be the same or different and may be selected from branched and straight chain alkyl groups. Preferred are groups containing 1 to 8 carbon atoms.

The sulfur compounds are known to possess certain lubricating properties such as oxidation, wear and corrosion inhibition in various lubricating media. Sometimes, however, the sulfur compounds alone do not provide adequate antiwear protection for the varied heavy duty applications of many industrial and automotive lubricants.

Moreover, under certain conditions, the high concentrations of sulfur compounds may produce an adverse effect on the overall performance of the lubricant. For instance, the so called sulfur donors may produce undesirably large amounts of sulfur compounds on the protected surface.

Unexpectedly, the above sulfur compounds produce synergistic antiwear effect when combined with organomolybdenum compounds in certain ratios. The synergistic compositions of the invention appear to produce metallurgical changes in the surface to be protected. The change manifests in lower friction and consequently, higher antiwear protection. Synergism is displayed by compositions containing about 1 to 5 parts by weight of the sulfur compound to about 5 to 1 part by weight of the molybdenum compound and preferably "about 1 to 2 parts by weight of the sulfur compound to about 2 to 1 parts by weight of the molybdenum compound.

Another advantage of the synergistic combination is that the compositions possess good antioxidant properties. Even in instances where the sulfur compounds do not possess an antioxidant activity, the combination with the molybdenum complexes provides a composition with good overall antioxidant properties.

The synergistic compositions may be incorporated in any lubricating media by known methods. The compositions impart antiwear as well as oxidation inhibiting and extreme pressure properties to natural and synthetic lubricants formulated as oils or greases.

The base oils employed as lubricant vehicles are typical natural and synthetic oils used in automotive and industrial applications such as, among others, turbine oils, hydraulic oils, gear oils, crankcase oils and diesel oils. Natural base oils include mineral oils, petroleum oils, paraffinic oils and the ecologically desirable vegetable oils. Typical synthetic oils include ester-type oils such as silicate esters and pentaerythritol esters, hydrogenated mineral oils, silicones and silanes.

The compositions of the invention may be incorporated in the lubricant in an amount effective to produce the desired antiwear characteristics. An amount from about 0.1 to 10.0 percent will be sufficient for most applications. A preferred range is from about 0.5 to about 3.0 percent by weight of the total lubricant composition.

The lubricating compositions may contain other conventional additives depending on the intended use of the lubricant. For example, formulations may contain rust inhibitors such as metal salts of alkylnaphthalenesulfonic acids. Other additives are antioxidants such as alkylated diphenylamines, e.g. commercially available products VANLUBE®SL, DND, NA, 81 and 961 manufactured by R.T. Vanderbilt Company, Inc., Naugalube® 640, 680 and 438L manufactured by Uniroyal Chemical and Irganox®L-57 manufactured by Ciba-Geigy. Other additives include, among others, demulsifiers, dispersants, detergents and supplemental antioxidants.

The grease formulations may contain various thickening agents such as, among others, silicate minerals, metal soaps and organic polymers.

The following examples are given for the purpose of illustrating the invention and are not intended in any way to limit the invention. All percentages and parts are based on weight unless otherwise indicated.

EXAMPLE 1

A laboratory test was conducted by using the original Falex machine to simulate the valve train wear of an automobile engine. The V-blocks and pin were washed in mineral spirits with an ultrasonic cleaner, rinsed with acetone, air dried and weighed. The test sample (60 g) was placed into the oil cup. The motor was switched on and the loading arm was placed on the ratchet wheel. Upon reaching the reference load of 227 kg, the ratchet wheel was disengaged and the load was maintained constant for 3.5 hours. Thereafter, the motor was switched off. The V-blocks and pin were washed, dried and weighed. The weight loss, a measure of wear, was recorded and compiled in Table I.

The test samples were prepared by adding a molybdenum complex and zinc O,O-di-$C_{1-14}$-alkyl-phosphorodithioate (hereinafter zinc phosphorodithioate) alone and in combination to the base oil (Sun 100 N manufactured by Sun Refining and Marketing Company), in the amount given in Table I. The molybdenum complex is a reaction product of coconut oil, 2,2'-iminobisethanol and hexaammonium salt of molybdic acid.

The results indicate that the molybdenum complex and the zinc phosphorodithioate act synergistically towards inhibition of wear.

TABLE I

Modified Falex Wear Test

| | Component, Mass Percent | | | | |
|---|---|---|---|---|---|
| Sample | 1 | 2 | 3 | 4 | 5 |
| Molybdenum complex | 1.5 | — | 1.0 | 0.75 | 0.5 |
| Zinc phosphorodithioate | — | 1.5 | 0.5 | 0.75 | 1.0 |
| Test Parameters | | | | | |
| Test Time, min. | 75* | 24* | 210 | 210 | 210 |
| Total Weight Loss, mg. | 542.8 | 543.9 | 39.9 | 39.4 | 9.4 |

*Test terminated due to excessive wear

EXAMPLE 2

The modified Falex Wear Test described in Example 1 was performed with the same molybdenum complex in conjunction with the following ashless sulfuir compound synergists of the invention: S-dicarbobutoxyethyl O,O-dipropylphosphorodithioate (hereinafter phosphorodithioate ester), methylenebis(dibutyldithiocarbamate), and 2-(1,2-di (2-ethylhexoxycarbonyl)ethylthio)-1,3,4-thiadiazole-5-thiol (hereinafter 1,3,4-thiadiazole-5-thiol compound). The base oil was a hydrofinished naphthenic oil (ISO VG 22 manufactured by Sun Refining and Marketing Co.).

The results compiled in Table II herein indicate that the molybdenum complex and the above salts of the sulfur compounds act as synergists towards inhibition of wear.

TABLE II

Modified Falex Wear Test

| | Component, Mass Percent | | | | | | | |
|---|---|---|---|---|---|---|---|---|
| Sample | 6 | 7 | 8 | 9 | 10 | 11 | 12 | 13 |
| Molybdenum complex | 1.0 | 1.5 | — | 0.5 | — | 0.5 | — | 0.5 |
| Phosphorodithioate ester | — | — | 1.0 | 0.5 | — | — | — | — |
| Methylenebis-(dibutyldithiocarbamate) | — | — | — | — | 1.5 | 1.0 | — | — |
| 1,3,4-Thiadiazole-5-thiol compound | — | — | — | — | — | — | 1.0 | 0.5 |
| Test Parameters | | | | | | | | |
| Test Time, min. | 40* | 75* | 20* | 210 | 210 | 210 | 200* | 210 |

TABLE II-continued

| Modified Falex Wear Test | | | | | | | | |
|---|---|---|---|---|---|---|---|---|
| | Component, Mass Percent | | | | | | | |
| Sample | 6 | 7 | 8 | 9 | 10 | 11 | 12 | 13 |
| Total Weight Loss, mg. | 433 | 542.8 | — | 14.6 | 86.4 | 3.4 | 308.7 | 32.7 |

*Test terminated due to excessive wear

EXAMPLE 3

The modified Falex Wear Test described in Example 1 was performed with the same molybdenum complex in conjunction with the following metal salts of the sulfur compound synergists: nickel dilauryldithiocarbamate, calcium di-2-ethylhexyl-dithiophosphate, aluminum di-2-ethylhexyldithiophosphate, tellurium di 2-ethylhexyldithiophosphate, and $C_{12-14}$-alkylamine salt of tert-octyl phosphates (hereinafter dithiophosphate amine salt). The base oil was a hydrofinished naphthenic oil (ISO VG 22).

The results compiled in Table III herein indicate that the molybdenum complex and the above salts of the sulfur compounds act as synergists towards inhibition of wear.

EXAMPLE 4

A thin film oxygen uptake test was conducted essentially according to the method described by Chia-Soon Ju et al, *J. Am. Soc. Lubricating Eng.*, 40, 2, 75–83, 1984. The oxidation induction time of the lubricant was measured under conditions which simulate the high temperature oxidation processes in automotive engines by modified rotary bomb oxidation test method ASTM D-2272. The test was conducted with 1.5 gram samples of hydrofinished naphthenic oil, ISO VG 22. The composition of the invention described in Example 2, and, for comparison, the individual components, were added to the oil in the amount indicated in Table IV. The test was conducted at 160° C. and initial oxygen pressure of 620.6 kPa (90 psi). A "pass" oil has a high induction time, while a "fail" oil has a low induction time. The compositions of the invention display good antioxidative effect as demonstrated by the data compiled in Table IV.

TABLE IV

| Thin Oxygen Uptake Test | | | | |
|---|---|---|---|---|
| | Component, Mass Percent | | | |
| Sample | 25 | 26 | 27 | 28 |
| Molybdenum Complex | 1.0 | 1.5 | — | 0.5 |
| Methylenebis(dibutyldithiocarbamate) | | — | 1.5 | 1.0 |
| Test Parameter | | | | |
| Average Induction Time, min. | 10 | 10 | 75 | 93 |

EXAMPLE 5

The following series of experiments were conducted to demonstrate the synergistic performance of the compositions of the invention. Since the primary purpose of lubricants is to protect metal surfaces, changes in the surface metallurgy of steel were investigated by using the individual components and the synergistic compositions. The metallurgical changes were investigated in terms of coefficient of friction which is interrelated to wear as demonstrated in Table 16.

TABLE 1

| BASE OIL SPECIFICATIONS<br>Description: Severely Hydrotreated Naphthenic Oil | |
|---|---|
| Aniline Point, ° F. | 139 |
| Sulfur, wt. % | 0.03 |
| % Naphthenic | 52.2 |
| % Paraffinic | 32.8 |
| % Aromatic | 15.0 |
| Viscosity, SUS 100° F. | 104 |

The Base Oil (BO) (UNINAP® 100SD, commercially available from Diamond Shamrock Corp.) was selected for having very low sulfur and good solubility (similar to fully formulated motor oil).

TABLE 2

FALEX NO. 1 FRICTION AND WEAR, TEST SPECIMENS

Test blocks: Low pressure design, 4620 Steel, RC 58-63, 6–12 rms, Test ring: S-10, 4620 steel, RC 58-63, 6–12 rms.

TABLE III

| Modified Falex Wear Test | | | | | | | | | | | |
|---|---|---|---|---|---|---|---|---|---|---|---|
| | Component, Mass Percent | | | | | | | | | | |
| Sample | 14 | 15 | 16 | 17 | 18 | 19 | 20 | 21 | 22 | 23 | 24 |
| Molybdenum complex | 1.5 | — | 0.5 | — | 0.5 | — | 0.5 | — | 0.5 | — | 0.5 |
| Nickel dithiocarbamate | — | 1.5 | 1.0 | — | — | — | — | — | — | — | — |
| Calcium dithiophosphate | — | — | — | 1.5 | 1.0 | — | — | — | — | — | — |
| Aluminum dithiophosphate | — | — | — | — | — | 1.5 | 1.0 | — | — | — | — |
| Tellurium dithiophosphate | — | — | — | — | — | — | — | 1.5 | 1.0 | — | — |
| Dithiophosphate amine salt | — | — | — | — | — | — | — | — | — | 1.5 | 1.0 |
| Test Parameters | | | | | | | | | | | |
| Test Time, min. | 75* | 5* | 210 | 5* | 210 | 210 | 210 | 120* | 210 | 2* | 210 |
| Total Weight Loss, mg. | 542.8 | 366.8 | 14.9 | 366.6 | 90.1 | 33.5 | 18.4 | 84.8 | 17.7 | 5.6** | 41.9 |

*Test terminated due to excessive wear
**High galling fail

TABLE 3

| 4620 STEEL COMPOSITION (G46200 Ni—Mo Alloy Steel), mass percent | |
|---|---|
| C | 0.17–0.22 |
| Mn | 0.45–0.65 |
| Mo | 0.20–0.30 |
| Ni | 1.65–2.00 |
| P | 0.035 Max. |
| S | 0.040 Max. |
| Si | 0.15–0.35 |

Cross Reference Specifications: AISI 4620 AMS 6294 ASTM A29 (4620)

TABLE 4

FALEX NO. 1 FRICTION AND WEAR, TEST CONDITIONS

Test Conditions:

Fluid Volume: 100 mL, Fluid Temperature: 108° C., Rotational Speed: 800 rpm, Bale Load: 2.25 Kg, Actual Load on Specimen: 22.5 Kg, Test Duration: 90 min Low Pressure Block Design creates an area contact with S-10 Ring

TABLE 5

FALEX NO. 1 PROCEDURE

1. Clean ring and block with mineral spirits, then acetone and dry.
2. With ring and block in place, add the test fluid.
3. Make sure load has not been engaged and start drive, turn on heater and set automatic shut-off for 90 minutes.
4. When fluid temperature is reached, release the load.
5. When load is engaged, start time and begin chart recording friction force.
6. At end of test, solvent clean in mineral spirits in an ultrasonic cleaner for 20 minutes.

TABLE 6

COEFFICIENT OF FRICTION

| | initial | 5 min | 10 min | 20 min | 30 min | 40 min | 50 min | 60 min | 70 min | 80 min | 90 min |
|---|---|---|---|---|---|---|---|---|---|---|---|
| Base Oil: no additives | >0.20 | 0.128 | 0.129 | 0.121 | 0.117 | 0.107 | 0.099 | 0.095 | 0.091 | 0.089 | 0.090 |
| BO, ZnDTP[1], AFM | >0.20 | 0.144 | 0.140 | 0.130 | 0.119 | 0.111 | 0.106 | 0.102 | 0.102 | 0.099 | 0.093 |
| BO, ZnDTP, MV-855 | 0.169 | 0.121 | 0.096 | 0.071 | 0.059 | 0.054 | 0.046 | 0.040 | 0.036 | 0.033 | 0.031 |

BO: base oil, ZnDTP[1]: zinc dialkyldithiophosphate (0.92% mass LZ-1395 from LUBRIZOL CORP.)., AFM: ashless friction modifier which is the non molybdenum analog of the molybdate, MV-855: molybdenum complex described in Example 1 (0.5 mass %, 400 ppm Mo)

The data in Table 6 show the friction reduction properties of the base oil versus the base oil treated with ZnDTP and ashless friction modifier (MV-855 precursor), and also the base oil treated with ZnDTP and MV-855. This demonstrates little frictional benefit from the ashless friction modifier in combination with ZnDTP versus the base oil. Therefore, the incorporation of molybdenum in combination with ZnDTP results in a substantial reduction in friction.

TABLE 7

COEFFICIENT OF FRICTION

| | initial | 5 min | 10 min | 20 min | 30 min | 40 min | 50 min | 60 min | 70 min | 80 min | 90 min |
|---|---|---|---|---|---|---|---|---|---|---|---|
| Base oil wth ZnDTP[2] | 0.200 | 0.102 | 0.096 | 0.088 | 0.084 | 0.081 | 0.079 | 0.078 | 0.077 | 0.076 | 0.076 |
| Base oil with MV-855 | 0.118 | 0.128 | 0.122 | 0.096 | 0.080 | 0.070 | 0.060 | 0.052 | 0.048 | 0.046 | 0.044 |
| BO, ZnDTP, MV-855 | 0.170 | 0.050 | 0.048 | 0.046 | 0.043 | 0.041 | 0.039 | 0.038 | 0.037 | 0.036 | 0.035 |
| BO, ZnDTP, MV-855 | 0.164 | 0.044 | 0.040 | 0.036 | 0.032 | 0.028 | 0.027 | 0.024 | 0.023 | 0.023 | 0.023 |

BO: base oil, ZnDTP[2]: zinc dithiophosphate (1.31% mass OLOA 269R from CHEVRON CHEMICAL CORP.), MV-855: molybdenum complex described in Example 1 (0.5 mass %, 400 ppm Mo)

The data in Table 7 shows that the MV-855 combination with ZnDTP has a dramatically reduced coefficient of friction (consistent with unexpected synergism) versus the molybdate or ZnDTP performance alone in the base oil. Note that the wear film of ZnDTP does not significantly increase or decrease friction due to the physical difference in the surface coating (iron phosphate) versus the friction resulting from boundary/hydrodynamic lubrication. The molybdate additive-ZnDTP combination demonstrate a dramatic improvement in wear and frictional properties.

TABLE 8

| | COEFFICIENT OF FRICTION | | | | | | | | | | |
|---|---|---|---|---|---|---|---|---|---|---|---|
| | initial | 5 min | 10 min | 20 min | 30 min | 40 min | 50 min | 60 min | 70 min | 80 min | 90 min |
| BO, VL-871, MV-855 | 0.132 | 0.132 | 0.073 | 0.042 | 0.037 | 0.032 | 0.027 | 0.025 | 0.023 | 0.022 | 0.022 |
| Base Oil, no additives | 0.094 | 0.097 | 0.094 | 0.092 | 0.090 | 0.088 | 0.084 | 0.081 | 0.079 | 0.076 | 0.074 |
| BO, ZnDTP[1], MV-855 | >0.20 | 0.068 | 0.060 | 0.052 | 0.048 | 0.044 | 0.039 | 0.037 | 0.036 | 0.035 | 0.034 |

BO: Base Oil, ZnDTP[1]: zinc dithiophosphate (0.92% mass LZ-1395 from LUBRIZOL CORP.), VL-871: 0.94% mass of substituted 1,3,4-thiadiazole described in Example 2, MV-855: molybdenum complex described in Example 1 (0.5 mass % , 400 ppm Mo).

The data in Table 8 show the synergistic performance of the molybdate complex with substituted 1,3,4-thiadiazole antiwear additive. VL-871 has superior performance versus the ZnDTP. Unlike many other sulfur additives, oxidatively stressed oil containing this additive, demonstrate retention of the chemically intact additive (by Liquid Chromatography). Therefore, VL-871 does not function as a "sulfur donor" due to the stability of the compound.

To investigate the interaction of the substituted 1,3,4-thiadiazole (VL-871) in combination with the molybdate (MV-855) on the metal surface, the following tests were conducted. The same base oil and Falex No. 1 test equipment was utilized, but the test procedure has been modified as delineated below.

TABLE 9

COEFFICIENT OF FRICTION—TEST SPECIMENS RUN DRY—

Evaluations:

(1) Conditioning of metal test specimens with molydate additive (MV-855):
   a) 90 minutes with MV-855 in Base Oil (described in Table 1)
   b) Ultrasonic cleaning.
   c) 90 minutes with Base Oil Only.
   d) Ultrasonic cleaning.
   e) Metal specimen is run with no lubricant to evaluate metal surface for frictional properties.

(2) Conditioning of the metal test specimen with the additives of the investigation
   a) 90 minutes with MV-855 and VL-871 additive in base oil.
   b) Ultrasonic cleaning.
   c) 90 minutes with VL-871 additive in Base Oil.
   d) Ultrasonic cleaning.
   e) Metal specimen is run with no lubricant to evaluate metal surface for frictional properties.

Results:

TABLE 10

| | COEFFICIENT OF FRICTION | | | | | | | | |
|---|---|---|---|---|---|---|---|---|---|
| SECONDS> | 1 | 2 | 3 | 4 | 5 | 10 | 15 | 20 | 40 |
| #1 | .06 | .19 | .33 | .34 | .37 | .40 | .42 | .45 | — |
| #2 | .05 | .11 | .13 | .145 | .15 | .15 | .15 | .16 | .16 |
| Reference* | .23 | .35 | .39 | .39 | .41 | .39 | .38 | .35 | — |

*new block and ring without base oil additive formulation conditioning

Results indicate that the surface metallurgy has changed to provide significantly lower frictional properties of the metallurgy when the combination of thiadiazole derivative and molybdate are used. The reference coefficient of friction for the untreated metallurgy is consistent with the literature. Literature reference for coefficient of friction of hard steel on hard steel (dry) is 0.42, [*Mechanical Engineers Handbook*, Lionel S. Marks, page 218 (5th ed. 1952)].

The following data was obtained via the aforementioned procedure. Two 90 min. (2×90 min.) lubricated conditioning runs were conducted on each metal specimen prior to the non lubricant run (except for the reference new block and ring metal specimens).

TABLE 11

| COEFFICIENT OF FRICTION METAL SPECIMENS RUN WITH NO LUBRICANT (AFTER CONDITIONING WITH LUBRICANT AND ULTRASONIC CLEANING) | | | | | | | |
|---|---|---|---|---|---|---|---|
| 1st conditioning ‖ 2nd conditioning | 1 s | 2 s | 3 s | 4 s | 5 s | 10 s | 15 s |
| BO, ZnDTP, MV-855 ‖ BO, ZnDTP | 0.060 | 0.150 | 0.165 | 0.175 | 0.185 | 0.290 | 0.360 |
| Repeat of above | 0.045 | 0.100 | 0.150 | 0.160 | 0.170 | 0.350 | 0.390 |
| BO, ZnDTP,VL-896 ‖ BO, ZnDTP | 0.060 | 0.130 | 0.215 | 0.235 | 0.245 | 0.360 | 0.395 |
| Repeat of above | 0.065 | 0.120 | 0.265 | 0.280 | 0.300 | 0.415 | 0.460 |
| BO ‖ BO | 0.100 | 0.200 | 0.430 | 0.460 | 0.450 | 0.460 | 0.460 |
| New block and ring metal specimens | 0.165 | 0.310 | 0.440 | 0.430 | 0.400 | 0.401 | 0.401 |

The data in Table 11 indicate that the surface metallurgy has changed to provide significantly lower frictional properties of the metallurgy when the combination of ZnDTP and MV-855 are used. To further demonstrate that the metallurgy had significantly changed and that the molybdenum is not forming molybdenum disulfide related to sulfur donor theory, U.S. Pat. No. 4,164,473, metal analysis was conducted of the top surface of the test block for elemental composition. Data is expressed as atomic percent and is based on the emission spectra of the XPS method. Metal samples are irradiated by a soft x-ray source causing direct ejection of core level electrons from surface atoms. These electrons are energy analyzed in a high resolution analyzer, producing an emission spectrum of peaks on a sloping background. Every element has its own unique XPS spectrum. XPS peak positions are not fixed, but will shift depending on the valence/oxidation state of the atom and its chemical environment.

X-RAY PHOTOELECTRON SPECTROSCOPY (XPS) TEST BLOCK

FROM FALEX NO. 1 FRICTION TEST

Surface analysis on test block was conducted after first 90-minute test run followed by thorough cleaning of the metal specimens to remove lubricant residues. The frictional data of the conditioning with the lubricant are compiled in Table 12. The XPS analysis was accomplished on these metal specimens after ultrasonic cleaning and the data are compiled in Table 13.

The XPS data in atomic percent, show that this test metal has no molybdenum at detection limit of the method.

The following data demonstrate the frictional data which is interrelated to wear of the claimed synergism of the invention. This data further supports the unexpected interaction since the above experimental data show that the components perform dramatically differently than would be expected from the individual components.

TABLE 12

| | initial | 5 min | 10 min | 20 min | 30 min | 40 min | 50 min | 60 min | 70 min | 80 min | 90 min |
|---|---|---|---|---|---|---|---|---|---|---|---|
| BO, ZnDTP[2], MV-855 | >0.200 | 0.053 | 0.047 | 0.040 | 0.037 | 0.036 | 0.034 | 0.033 | 0.032 | 0.032 | 0.031 |

BO: base oil, ZnDTP[2]: zinc dithiophosphate (1.31% mass OLOA 269R from CHEVRON CHEMICAL CORP.), MV-855: molybdate additive (400 ppm Mo).

TABLE 13

XPS DEPTH PROFILE

Sample: conditioned block with BO containing molybdate friction modifier (MV-855)/ZnDTP[2].

| Angstrom Depth | Carbon | Oxygen | Silicon | Sulfur | Phosphorus | Iron | Nickel | Zinc | Molybdenum |
|---|---|---|---|---|---|---|---|---|---|
| 0 | 62.8 | 29.5 | 1.7 | DL | | 4.6 | DL | 0.44 | 0.99 |
| 12 | 47.3 | 21.4 | 0.52 | DL | | 29.8 | 0.49 | DL | 0.47 |
| 25 | 49.2 | 6.7 | | | | 42.9 | 0.63 | DL | 0.33 |
| 37 | 50.0 | 4.1 | | | | 44.9 | 0.57 | DL | 0.40 |
| 50 | 51.3 | 3.0 | | | | 44.5 | 0.61 | DL | 0.35 |
| 62 | 49.9 | 2.4 | | | | 46.8 | 0.73 | DL | 0.24 |

DL: detection limit (signal is not above background noise); no evidence of element.

The XPS data in atomic percent here demonstrate that molybdenum doping is found down to 60 angstroms supporting that metallurgical changes have occurred. This is clear when comparing a similar lubricant conditioned block with an ashless friction modifier (the molybdate precursor—but no molybdenum) in the XPS profile in Table 14.

TABLE 14

XPS DEPTH PROFILE

Sample: conditioned block with BO containing ashless friction modifier (molybdate precursor - but no molybdenum)/ZnDTP[2]; After ultrasonic cleaning of the metal specimens, the XPS analysis was conducted.

| Depth | Carbon | Oxygen | Silicon | Sulfur | Phosphorus | Iron | Nickel | Zinc | Molybdenum |
|---|---|---|---|---|---|---|---|---|---|
| 0 | 56.0 | 32.8 | 1.7 | 4.0 | 0.59 | 1.8 | | 3.1 | |
| 12 | 42.7 | 16.3 | 1.3 | 3.5 | DL | 33.5 | 0.30 | 2.5 | |
| 25 | 42.0 | 16.2 | DL | 2.1 | DL | 37.8 | 0.36 | 1.6 | |
| 37 | 44.2 | 7.0 | DL | 1.7 | DL | 45.1 | 0.58 | 1.3 | DL |
| 50 | 42.2 | 5.8 | DL | 1.2 | | 49.3 | 0.60 | 0.92 | DL |
| 62 | 39.8 | 5.8 | | 0.89 | | 51.5 | 0.77 | 0.91 | DL |

TABLE 15

Falex No. 1 Friction Test Results - Low Pressure

| Base Oil-Uninap 100SD | | | Friction Force, lb (Coefficient of Friction) | |
|---|---|---|---|---|
| Concentration in Base Oil | | | At Start | End of 15 minutes |
| 1. | MV-855 | 1.5% | 9.10(0.182) | 5.60(0.112) |
| 2. | MV-855 | 0.5% | 9.40(0.190) | 4.05(0.081) |
| | ZnDTP[1] | 1.0% | | |
| 3. | MV-855 | 0.5% | 8.60(0.172) | 2.80(0.056) |
| | VL-871 | 1.0% | | |
| 4. | ZnDTP[1] | 1.5% | 9.55(0.191) | 6.85(0.137) |
| 5. | VL-871 | 1.5% | 8.95(0.179) | 2.95(0.059) |
| 6. | VL-SB | 1.5% | 5.35(0.107) | 2.50(0.050) |
| 7. | MV-855 | 0.5% | 5.2(0.104) | 3.35(0.067) |
| | VL-SB | 1.0% | | |

VL: VANLUBE ® manufactured by R T Vanderbilt Company, Inc., VL-SB: polysulfurized isobutylene, VL-871: substituted 1,3,4-thiadiazole.

Other than supporting the unexpected performance of the additive combination, the above data also shows that all sulfur compounds do not afford this performance. This is clearly the case of the polysulfurized isobutylene additive, which is used for comparison.

It is clear from metallurgical science that molybdenum iron/steel is harder and thus improves the wear performance of the metal. The data presented within demonstrate that molybdenum is incorporated into the metallurgy and that the specific synergistic combinations of the invention facilitate this metallurgical change. The frictional property changes have been presented. The following data are additional experiments to demonstrate the unexpected wear performance induced by the invention and a direct result of the metallurgical changes demonstrated.

TABLE 16

FALEX PIN AND VEE BLOCK TESTING
Weight Loss, mg

| | | | | | | | | |
|---|---|---|---|---|---|---|---|---|
| WEAR | LOW WEAR "PASS" | | 18.7 mg | 39.9 mg | 39.4 mg | 9.4 mg | | |
| | HIGH WEAR "FAIL | 543+ mg | | | | | **** | 544+ mg |
| CONC. IN BASE OIL | MV-855 | 1.5% | 1.25% | 1.0% | 0.75% | 0.5% | 0.25% | 0% |
| | OLOA 269 | 0% | 0.25% | 0.5% | 0.75% | 1.0% | 1.25% | 1.5% |

****Test could not maintain load due to excessive wear on test specimen. This required early termination of test with a "fail" designation (wear would be in excess of 500 mg).

The above embodiments have shown various aspects of the present invention. Other variations will be evident to those skilled in the art and such modifications are intended to be within the scope of the invention as defined by the appended claims.

We claim:

1. A lubricating composition comprising an oil of lubricating viscosity and about 0.1 to 10.0 percent by weight of a synergistic antiwear composition consisting essentially of (a) an organomolybdenum complex prepared by reacting about 1 mole fatty oil, about 1.0 to 2.5 moles diethanolamine and a molybdenum source sufficient to yield about 0.1 to 12.0 percent of molybdenum based on the weight of the complex and (b) an organic sulfur compound selected from the group consisting of (i) a 1,3,4-thiadiazole compound being 2-(1,2-di(2-ethylhexoxycarbonyl)-ethylthio)-1,3,4-thiadiazole-5-thiol or 2,5-bispinanyl-1,3,4-thiadiazole (ii) bisdithiocarbamate compounds of the formula

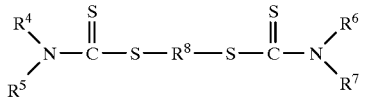

wherein $R^4$, $R^5$, $R^6$ and $R^7$ are aliphatic hydrocarbon groups having 1 to 13 carbon atoms and $R^8$ is an alkylene group having 1 to 8 carbon atoms;

(iii) dithiocarbamates of the formula

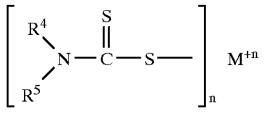

wherein $R^4$ and $R^5$ represent the groups defined hereinabove and M is nickel and salt moiety formed from an amine of the formula

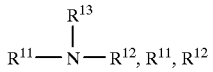

and $R^{13}$ being independently selected from hydrogen and aliphatic groups having 1 to 18 carbon atoms and n is the valence of M; and (v) phosphorodithioate esters of the formula

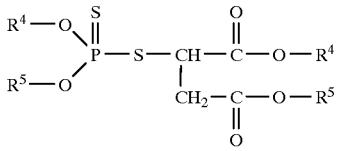

wherein $R^4$ and $R^5$ may be the same or different and are selected from alkyl groups having 1 to 8 carbon atoms, and the ratio of the molybdenum complex to the sulfur compound is about 1:2 to about 2:1.

2. A synergistic antiwear composition consisting essentially of:

(a) an organomolybdemum complex prepared by reacting about 1 mole fatty oil, about 1.0 to 2.5 moles diethanolamine and amolybdenum source sufficient to yield about 0.1 to 12.0 percent of molybdenum based on the weight of the complex and (b) an organic sulfur compound being a 1,3,4-thiadiazole compound, wherein the ratio of the molybdenum complex to the sulfur compound is about 1:2 to about 2:1, and wherein the 1,3,4-thiadiazole compound is 2-(1,2-di (2-ethylhexoxycarbonyl)-ethylthio)-1,3,4-thiadiazole-5-thiol.

3. A synergistic antiwear composition consisting essentially of:

(a) an organomolybdemum complex prepared by reacting about 1 mole fatty oil, about 1.0 to 2.5 moles diethanolamine and amolybdenum source sufficient to yield about 0.1 to 12.0 percent of molybdenum based on the weight of the complex and (b) an organic sulfur compound being a 1,3,4-thiadiazole compound, wherein the ratio of the molybdenum complex to the sulfur compound is about 1:2 to about 2:1, and wherein the 1,3,4-thiadiazole compound is 2,5-bispinanyl-1,3,4-thiazole.

4. A synergistic antiwear composition consisting essentially of:

(a) an organomolybdenum complex prepared by reacting about 1 mole fatty oil, about 1.0 to 2.5 moles diethanolamine and a molybdenum source sufficient to yield about 0.1 to 12.0 percent of molybdenum based on the weight of the complex and (b) a bisdithiocarbamate compound of the formula

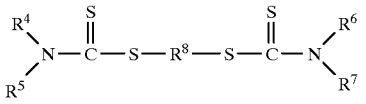

wherein $R^4$, $R^5$, $R^6$ and R7 are aliphatic hydrocarbon groups having 1 to 13 carbon atoms and $R^8$ is an alkylene group having 1 to 8 carbon atoms and the ratio of the molybdenum complex to the bisdithiocarbamate is about 1:2 to about 2:1.

5. A composition according to claim 4 wherein the bisdithiocarbamate compound is methylenebis (dibutyldithiocarbamate).

6. A synergistic antiwear composition consisting essentially of:

(a) an organomolybdenum complex prepared by reacting about 1 mole fatty oil, about 1.0 to 2.5 moles diethanolamine and a molybdenum source sufficient to yield about 0.1 to 12.0 percent of molybdenum based on the weight of the complex and (b) a dithiocarbamate of the formula

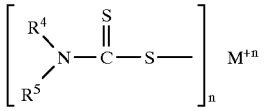

wherein $R^4$ and $R^5$ represent alkyl groups having 1 to 8 carbon atoms and M is nickel and a salt moiety formed from an amine of the formula

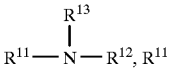

and $R^{13}$ being independently selected from hydrogen and aliphatic groups having 1 to 18 carbon atoms, and n is the valence of M, and the ratio of the molybdenum complex to the dithiocarbamate is about 1:2 to about 2:1.

7. A synergistic antiwear composition consisting essentially of:

(a) an organomolybdenum complex prepared by reacting about 1 mole fatty oil, about 1.0 to 2.5 moles diethanolamine and a molybdenum source sufficient to yield about 0.1 to 12.0 percent of molybdenum based on the weight of the complex and (b) a phosphorodithioate ester of the formula

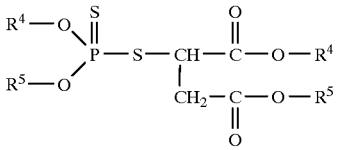

wherein $R^4$ and $R^5$ ray be the same or different and are selected from alkyl groups having 1 to 8 carbon atoms, and the ratio of the molybdenum complex to the ester is about 1:2 to about 2:1.

8. A composition according to claim 7 wherein the ester is S-dicarbobutoxyethyl O,O-dipropylphosphorodithioate.

* * * * *